US007806708B2

(12) United States Patent
Erstad

(10) Patent No.: US 7,806,708 B2
(45) Date of Patent: Oct. 5, 2010

(54) MEANS FOR TRANSFERRING ELECTRIC POWER IN A TURRET-MOORED VESSEL AND METHOD OF ASSEMBLY

(75) Inventor: Jostein Erstad, Ask (NO)

(73) Assignee: Framo Engineering AS, Bergen (NO)

( * ) Notice: Subject to any disclaimer, the term of this patent is extended or adjusted under 35 U.S.C. 154(b) by 311 days.

(21) Appl. No.: 11/666,566

(22) PCT Filed: Nov. 9, 2005

(86) PCT No.: PCT/NO2005/000422

§ 371 (c)(1),
(2), (4) Date: Oct. 18, 2007

(87) PCT Pub. No.: WO2006/052144

PCT Pub. Date: May 18, 2006

(65) Prior Publication Data

US 2008/0121162 A1 May 29, 2008

(30) Foreign Application Priority Data

Nov. 9, 2004 (NO) ..... 20044873

(51) Int. Cl.
*H01R 4/60* (2006.01)

(52) U.S. Cl. ..... 439/204; 114/230.12

(58) Field of Classification Search ..... 439/204–205, 439/604; 114/230.12
See application file for complete search history.

(56) References Cited

U.S. PATENT DOCUMENTS

| | | | | |
|---|---|---|---|---|
| 3,544,949 A | | 12/1970 | Panasjuk | |
| 3,729,699 A | * | 4/1973 | Briggs et al. | 439/140 |
| 4,003,620 A | * | 1/1977 | O'Brien et al. | 439/204 |
| 4,050,765 A | * | 9/1977 | Duesterhoeft et al. | 439/205 |
| 4,142,767 A | | 3/1979 | Karl et al. | |
| 4,252,388 A | | 2/1981 | Brady | |
| 4,294,500 A | | 10/1981 | Wilson | |
| 5,517,937 A | * | 5/1996 | Lunde | 114/230.12 |
| 6,050,747 A | | 4/2000 | Midttveit | |
| 6,176,193 B1 | * | 1/2001 | Whitby et al. | 114/230.12 |
| 6,302,048 B1 | | 10/2001 | Smedal | |

FOREIGN PATENT DOCUMENTS

| | | |
|---|---|---|
| EP | 0259072 | 3/1988 |
| EP | 0 833 770 B1 | 9/2001 |
| GB | 928599 | 6/1963 |
| GB | 1447413 | 8/1976 |
| GB | 1468133 | 3/1977 |
| WO | WO 99/65762 | 12/1999 |

* cited by examiner

*Primary Examiner*—Truc T Nguyen
(74) *Attorney, Agent, or Firm*—Merchant & Gould P.C.

(57) ABSTRACT

Means for transferring electric power and/or signals comprises an electrical power slip-ring system (EPSR) (3) comprising a housing (4) containing an electrical slip-rings, the housing (4) being connected to a support structure (6) of a vessel (7) and a brush carrier unit (8) that is in slidable contact with the electrical conductor means, the brush carrier (8) being fixed to a turret (2). A swivel unit (10) extends thorough the center of the housing (4). The turret (2) and support structure (6) may be disposed on the vessel in various configurations such as an internal turret configuration, a submerged turret configuration or an external turret configuration.

18 Claims, 19 Drawing Sheets

MEANS FOR TRANSFERRING ELECTRIC POWER IN A TURRET-MOORED VESSEL AND METHOD OF ASSEMBLY

The invention relates to means for the transferral of electric power and/or signals between two elements rotating in relation to each other, which elements for instance may be a floating unit and an underwater installation and the method of assembling the means and is concerned particularly, although not exclusively, with a system for transferring electrical power in a turret-moored vessel.

BACKGROUND OF THE INVENTION

When developing an oilfield one may for instance use underwater installations and lines up to an turret arranged in a floating unit for instance a vessel. The turret allows the floating unit to rotate in relation to the underwater installation, and thereby the lines running from the floating unit to the underwater installation will not be tangled or experience unnecessary stresses. An example on such a solution is described in U.S. Pat. No. 6,176,193.

The turret is arranged rotating in relation to the vessel, and there are normally arranged swivel means within or on top of the turret construction for transferral of fluids, electric power or signals between the vessel and the underwater installation. U.S. Pat. No. 6,302,048 and WO 9965762 describe such solutions. The turret with swivel means are normally designed for a specific use, for instance for a specific oil or oil/gas or gas field. The swivels and turrets have to be designed for optimum weight and size. Due to the requirements of weight and use of space there is normally limited options for expanding the swivel means with additional functionalities as for instance transferral of additional electric power which were not part of the initial criteria of the swivel means. These additional functionalities are criteria which may arise when the field is partly developed, which arise due to new available technology or development in the field which was not predicted. However, when an additional function of the swivel has to be retrofitted there is very limited space on the turret to add to or adapt the original swivel means to make room for the necessary changes. In addition it is also quite important to achieve a solution where the down time is as short as possible. To disassemble the original swivel means and replacing the whole assembly with another swivel means is not a preferred solution, and is often impractical.

It is therefore a need to develop a solution for transferring electrical power which gives a possibility to add additional transfer opportunities to a turret with an existing swivel means, without the need for extra space on top of the swivel and with as little or no down time for the existing transfer arrangement in the turret.

An aim of the present invention is to fulfil these needs. The present invention as defined in the following claims solves these needs.

The present invention relates to a system for achieving transfer of electric power, and/or signals, between a vessel and an underwater installation. Where one rotating element, the vessel, is connected to the static element and the underwater installation, through a turret, is rotationally attached to the vessel or rotating element. The system may be the only system for transfer between the elements.

DISCLOSURE OF THE INVENTION

The present invention provides an advantage over the known arrangements by providing means for the transferral of electric power and/or signals between two elements rotating in relation to each other, which elements for instance may be a vessel and an underwater installation and is concerned particularly, although not exclusively, with a system for transferring electrical power in a turret-moored vessel.

According to a first aspect of the present invention there is provided means for transferring electric power and/or signals between a vessel and an underwater installation via a turret, wherein the means for transferring electric power and/or signals comprises a slip-ring arrangement comprising a housing containing an electrical conductor means and a brush carrier unit that is in slidable contact with the electrical conductor means.

Preferably, the housing is connected to the structure of the vessel and the brush carrier is fixed to the turret. Alternatively, the brush carrier is connected to the structure of the vessel and the housing is fixed to the turret.

Preferably, the housing is formed by a plurality of sub-units, wherein each sub-unit comprises a section of the electrical conductor means. The housing sub-units may be prefabricated and tested prior to being assembled on the vessel and preferably the housing sub-units may be prefabricated and tested away from the vessel and then assembled on the vessel.

The housing is preferably mounted outside any swivel stacks and most preferably the housing is disposed outside and above any swivel stacks.

The housing is preferably a substantially annular shape formed by a plurality of sector sub-units. The sub-units may be secured together by a "cold work" method such as bolts or clamps. It is preferable that the sub-units are secured together by a securing means that does not require any "hot work" such as welding because during the operation of the vessel there may be a hazardous environment.

The housing unit is preferably an enclosed structure formed with an access channel through which the brush carrier unit extends.

The access channel preferably extends through the length of the housing.

Preferably the channel extends around the circumference of the housing.

The housing is preferably suspended from a support structure mounted on the vessel.

The housing is preferably suspended by three mounting points on the support structure.

The support structure preferably extends along the length of the housing.

The support structure preferably extends around the circumference of the housing.

The housing preferably comprises means for sealing the channel. The sealing means helps to prevent the ingress of the ambient (potentially explosive) atmosphere.

The means for sealing the channel preferably comprises a seal that extends along the length of the channel.

The seal means preferably comprises an internal seal member and an external seal member.

The seal means preferably comprises a sealing plate that extends the length of the seal means.

The seal means preferably comprises a sealing plate that extends the length of the seal means, the arrangement being such that in use a seal member is in sealing contact with the sealing plate.

The seal means is preferably a dynamic seal having a continuous sealing surface.

In use, there is preferably a positive pressure difference between the pressure in the housing compared with the atmospheric pressure outside the housing. The greater than atmospheric pressure inside the housing helps to prevent the ingress of the ambient (potentially explosive) atmosphere.

Preferably the slip-ring arrangement is a passive system that does not require drive means. It shall be appreciated that the rotation of the vessel provides the drive means.

The slip-ring arrangement preferably comprises damping means to restrict minor movements of the slip-ring arrangement. The damping means preferably comprises a torque assembly mounted to the slip-ring arrangement. The torque assembly preferably connects the bush carrier to the turret.

According to a second aspect of the present invention there is provided a method of assembling a slip-ring arrangement comprising a plurality of sub-units, wherein each sub-unit comprises a section of the electrical conductor means according to the first aspect of the present invention, wherein the method comprises the steps of installing a support track on the vessel and transferring each sub-unit onto the support rack to form the completed slip-ring arrangement.

The housing sub-units may be prefabricated and tested prior to being assembled on the vessel and preferably the housing sub-units may be prefabricated and tested away from the vessel and then assembled on the vessel.

It shall be appreciated that one or more of the features described below with reference to the drawings of the invention may be used in conjunction with the features of the first and second aspects of the invention described above.

BRIEF DESCRIPTION OF THE DRAWINGS

A specific embodiment of the invention will now be described by way of example with reference to the accompanying drawing, in which:—

FIGS. 12*a*, 12*b*, 13*a*, 13*b* and 14, are a further detailed views of further embodiments of a seal arrangement for the slip-ring housing;

DESCRIPTION OF THE SPECIFIC EMBODIMENTS

Figure 1:
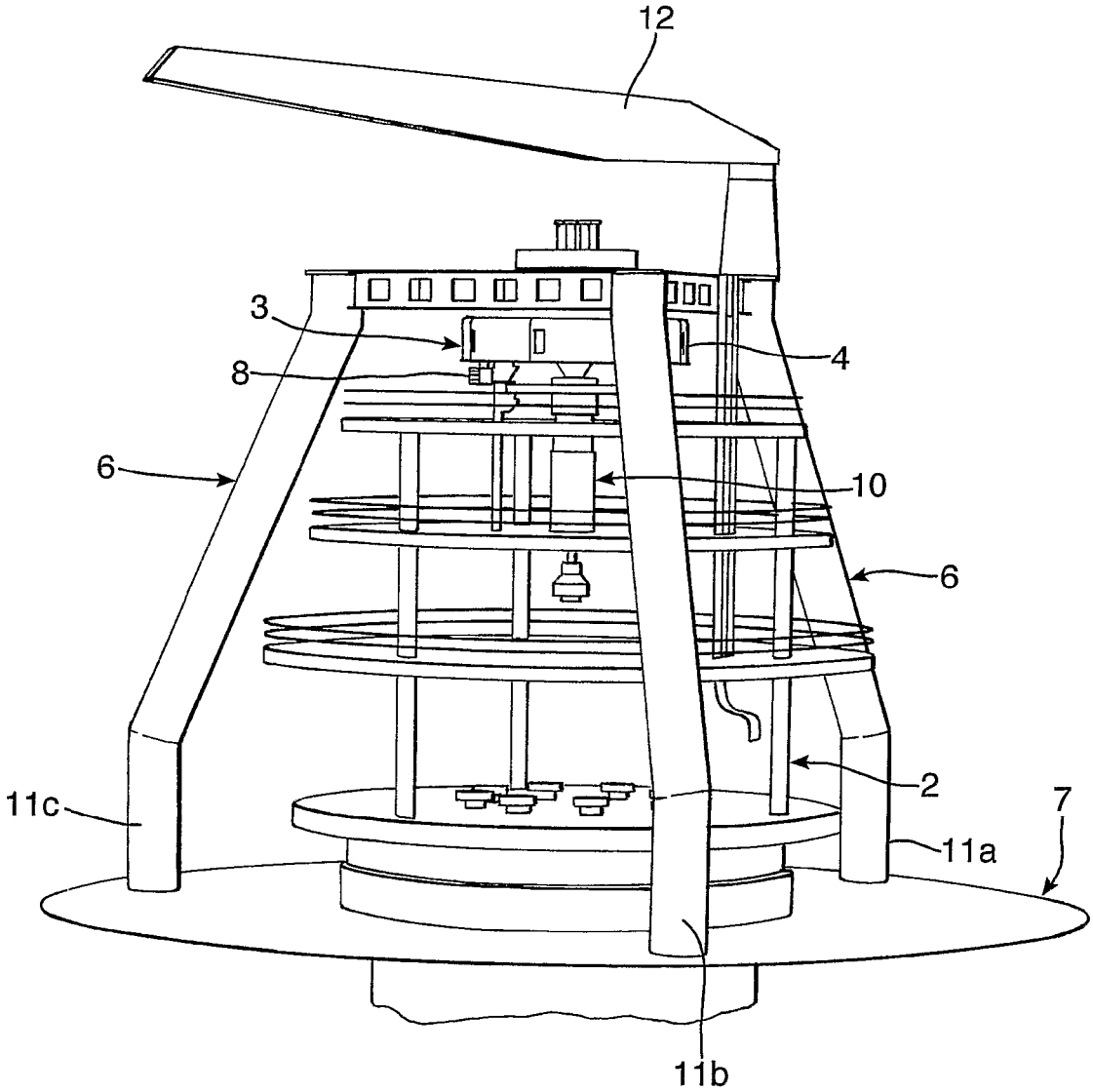
FIG. 1 is a side perspective view of a turret for a vessel and shows a swivel unit and a slip-ring housing and brush carrier.
Figure 2:
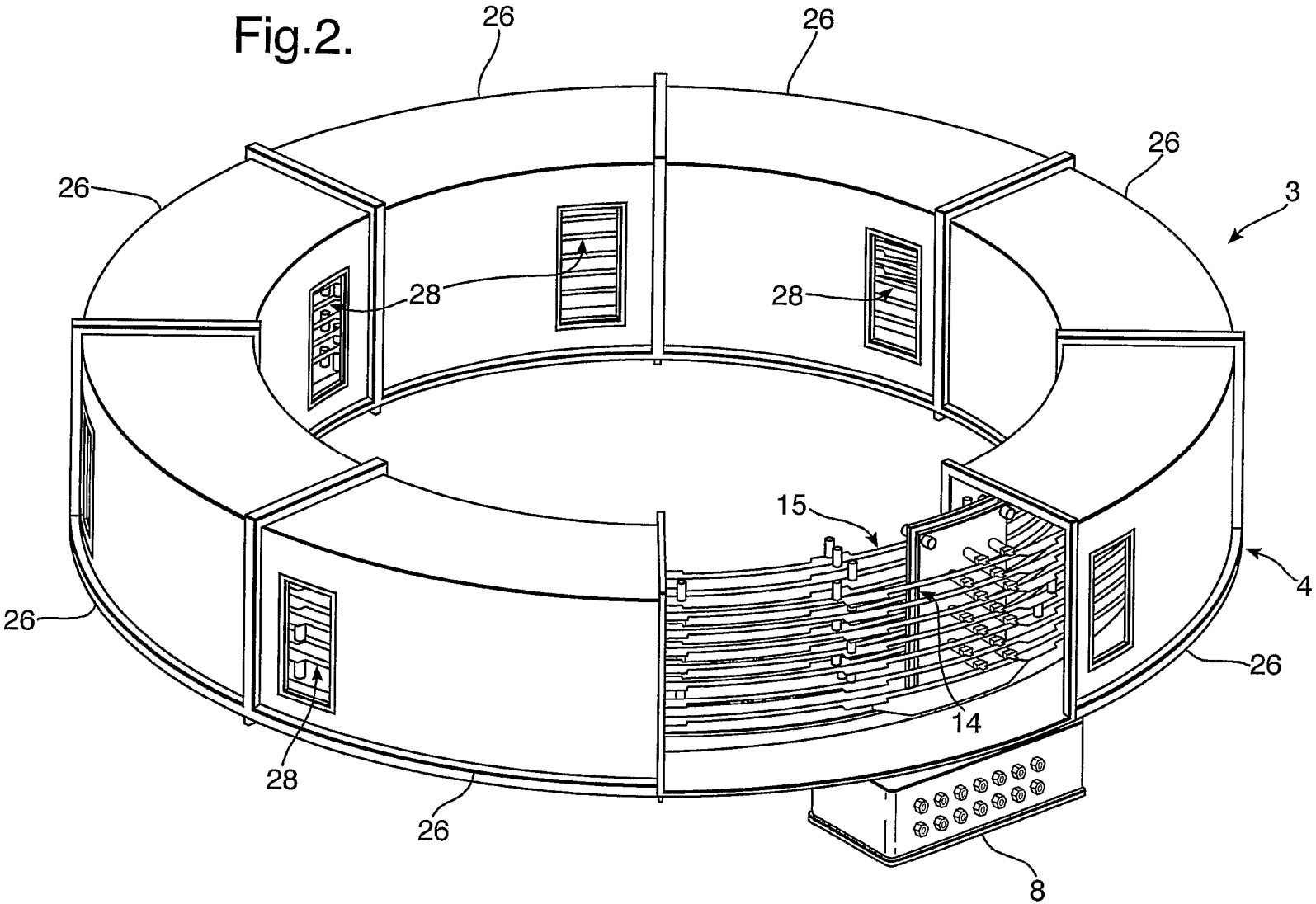
FIG. 2 is a perspective view of the top of the slip-ring housing and bush carrier shown in FIG. 1 and shows the housing with a section of the housing removed and partially ghosted.
Figure 3:
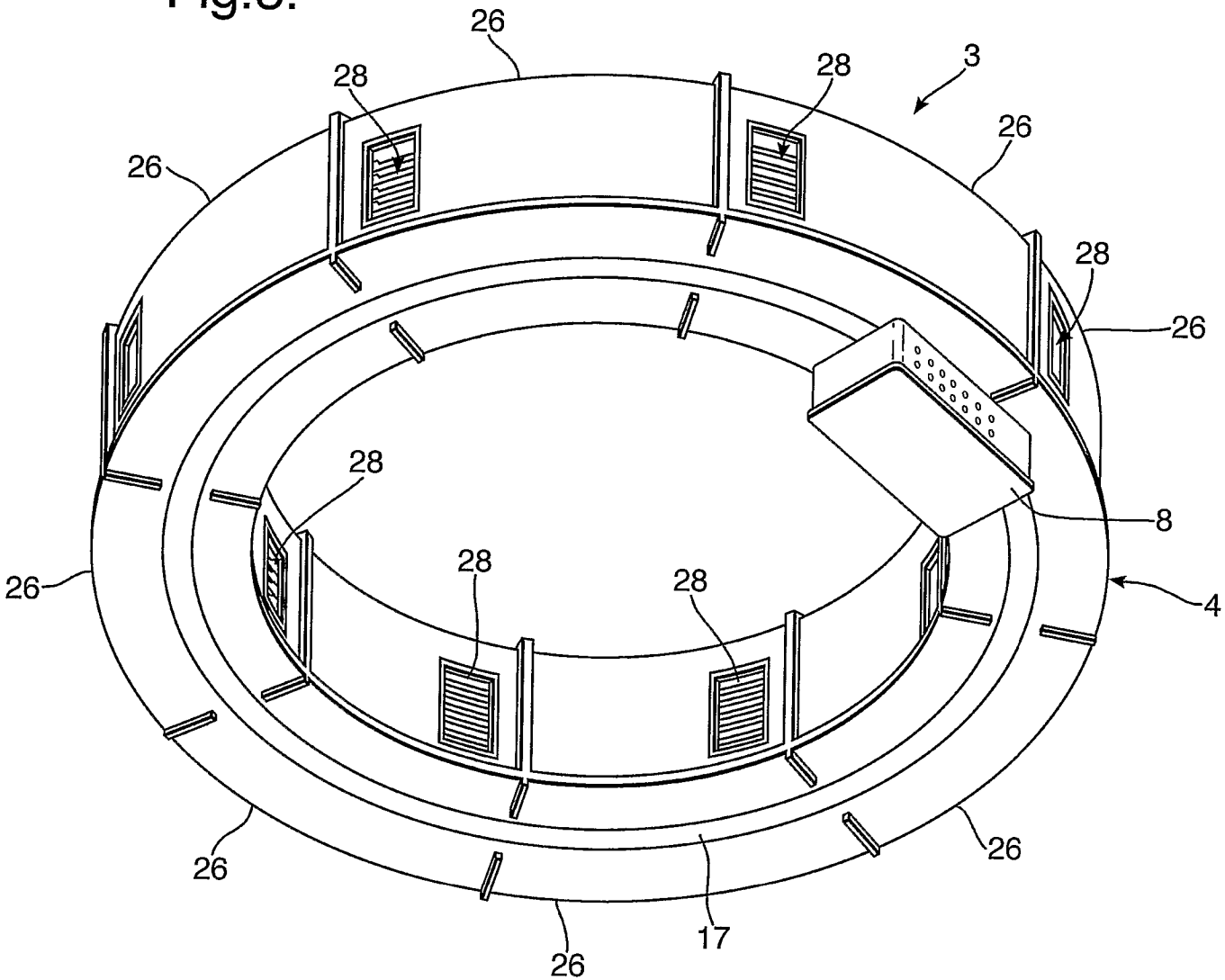
FIG. 3 is a perspective view of the bottom of the slip-ring housing and bush carrier shown in FIGS. 1 and 2.

With reference to the Figures, there is shown a turret 2, means for transferring electric power and/or signals comprising an electrical power slip-ring system (EPSR) 3 comprising a housing 4 containing electrical slip-rings. The housing 4 is connected to a support structure 6 of a vessel 7 and a brush carrier unit 8 is in slidable contact with the electrical conductor means. The brush carrier 8 is fixed to the turret 2 and a swivel unit 10 extends thorough the centre of the housing 4. The turret 2 and support structure 6 may be disposed on the vessel in various configurations such as an internal turret configuration, a submerged turret configuration or an external turret configuration.

The housing 4 is an enclosed square box structure formed with an access channel 5 through which the brush carrier 8 unit extends. The channel 5 extends around the circumference of the housing 4.

The support structure 6 is formed with three tubular column sections 11*a*, 11*b*, 11*c*. Disposed at the top of section 11*a* is a cantilever crane 12. The housing 4 of the EPSR system 3 has a relatively large diameter slip-ring compared to existing solutions. Typical range of large diameter slip-ring systems are in the region from 2.05 meters up to 15 meters.

The main challenges for the EPSR system 3 of the present invention through the conceptual development phase have been:

- Finding available space in the gantry structure of the vessel
- Establish a solution that can be efficiently and safely installed
- Avoid any hot-work in association with the installation
- Establish consequential impacts on other systems from the EPSR
- Substantiate that the EPSR provides a solution for vessel-side to turret transfer of electrical power, low voltage supply and signals in an EX environment The EPSR system 3 transfers power between the rotating deck of the vessel 7 and the deck of the stationary turret 2. The EPSR system 3 includes four off three phase high voltage (HV) circuits 15 kV/300 A for the transfer of power to sub sea pumps as well as low voltage (LV) circuits (440 V/16 A, 230 V/16 A and 24 VDC/16 A) for powering equipment located on the turret 2.

The EPSR system 3 is designed with two high voltage (HV) ring stacks 14, 15 located on two diameters, each stack holding two off three phase HV circuits. In between the two stacks 14, 15, the carrier 8 is located holding all the brushes. The carrier 8 can travel between the two stacks 14, 15 all the way around the circle of the two stacks. The following typical electrical data for the HV slip rings:

| | |
|---|---|
| Number of rings: | 14 rings (4 × 3 phases + 1 × PE + 1 × Bonding) |
| Voltage rating: | 8.7/15(17.5) kV |
| Current rating: | 300 A |

The rings in the HV stack will have the following dimensions: h=8 mm and w=75 mm. Each ring will have a cross section of: 8×75 mm=600 mm2.

The rated current of each phase is In=300 A. The current will flow from the cable through the ring to the brush. Depending on the position of the brush relative to the cable termination to the ring, the current distribution in the ring will change. If the brush and the termination point is 180 degree spaced, the current will follow from the termination point to the brush in each half of the ring. This corresponds to a current in each half of the ring of 150 A, corresponding to a current density of: i=150/600=0.25 A/mm2. If the brush and the termination point is in the same position/very close, the current will tend to follow the shortest way between the termination and the brush. The current in the ring will therefore be max. 300 A, corresponding to a current density of: i=300/600=0.5 A/mm2. The current load may be very low, and the current rating can easily be increased.

Each ring will be split into eight sections 26 in order to follow each enclosure section of the EPSR system 3. This means that there are splices in each ring. The rating of each splice is holding the same current rating as the rest of the system.

Each phase will include two brushes. This solution is included in order to give redundancy, robustness as well as to cater for maintaining the current rating every time a brush passes a splice. Each brush has a current capacity of 400 A. the total current rating is thereby 800 A pr phase, utilizing the brushes to 37.5% (300 A) of the rated current.

From the brushes located on the carrier, a single conductor HV cable will be routed to the EPSR turret junction box, one cable from each brush. In the junction box there will be a HV connector interfacing to the turret HV cables, which are routed to the umbilical junction box on the turret. These connectors will secure a compact termination area as well as providing easy disconnection of the turret cables from the EPSR during maintenance. The junction box can be splitted in an upper section hanging on the EPSR carrier and a lower section holding the turret cables, all in order to ease the disconnection work during maintenance From the vessel side, cables are routed directly to the stacks 14, 15 in the EPSR system 3. From the carrier/brushes, intermediate cables are routed to a turret 2 HV junction box hanging on to the carrier, outside of the EPSR housing 4.

The LV rings are located in the top section of the EPSR system 3, with the rings fixed to the housing 4 and the brushes fixed to the carrier 8. The cables will be routed to an external LV junction box, with intermediate cables into the LV rings inside the EPSR system 3. From the LV brushes on the carrier 8, intermediate cables are routed to an external junction box located on the turret 2. From these junction boxes cables are routed to the different consumers on the turret 2.

The EPSR system 3 includes a system for protecting of the internal components of the housing 4 by using an overpressure system. The system will purge the EPSR system 3 prior to applying electrical power to the housing 4. During operation the overpressure system will maintain a predefined overpressure and compensate for the natural leakage from the housing 4. On loss of pressure, the system will initiate an alarm to be used for operator information or power shutdown.

The HV turret junction box may be an integral part of the EPSR system 3 and thereby be a part of the housing 4.

The main mechanical equipment assemblies of the EPSR system 3 are the slip-ring housing 4, the slip-ring internals, a sealing system and the brush carrier 8.

The sealing system between ambient and slip-ring system internals is a key part of the EPSR system 3. The internally over pressurized sealing system shall help to prevent any gas to enter into the internals of the high voltage environment. An external seal 17 is included to ensure that wind loads/other environmental conditions will not influence the internal sealing action.

The pressurization system serves to create (initial purging) and then maintain an overpressure in the EPSR enclosure. This overpressure shall prevent the ingress of the ambient (potentially explosive) atmosphere.

System Overview:

The EX pressurization system comprises of the following main items:

- Control cabinet unit incl. air connectors for instrument air inlet supply and output to EPSR enclosure
- Measuring point inside EPSR enclosure
- Outlet valve for purging sequence including measuring points for outlet air volume
- Interfaces:
  - Piping to supply instrument air inlet, EPSR and outlet valve pilot
  - Electrical: Power supply, control and monitoring signals Design Basis for Pressurization System:

In addition to the requirements defined above the following items are design basis:

- Supply inlet air to the system (control cabinet unit):
- Air quality: Instrument air quality
- Air flow rate: Min. approx. 1.200 l/min@8 bara
- Initial purging of the EPSR enclosure:
  - 5 off air exchanges in 1 hour: Approx. 9.000 l/min@approx. 15 mbar over-pressure
- Normal operation for pressurization of the EPSR enclosure with monitoring and compensation for leakages:
  - Limit values: Min. approx. 1 to 5 mbar overpressure, and max value according to EPSR enclosure pressure rating.

Operation of the Pressurization System

- Mode 1: Initial purging of the EPSR enclosure:
  - The air supply is turned on and the purge sequence starts after the minimum flow value is reached.
  - If the air flow of the EPSR enclosure during purging sequence drops below the pre-set value for minimum flow, the purging stops.
  - The required purging time is set by adjusting the purging volume (5×EPSR enclosure volume) and the pre-set inlet pressure.
- Mode 2: Normal operation, leakage compensation after initial purging:
  - The system is now in normal operation and required over-pressure is maintained by the system, compensating for leakages.
  - If the over-pressure in the EPSR enclosure drops below the pre-set min. value or exceeds the max. value an alarm is given.
  - Any action from the alarms from the system, on the power system must be decided.

Figure 4:
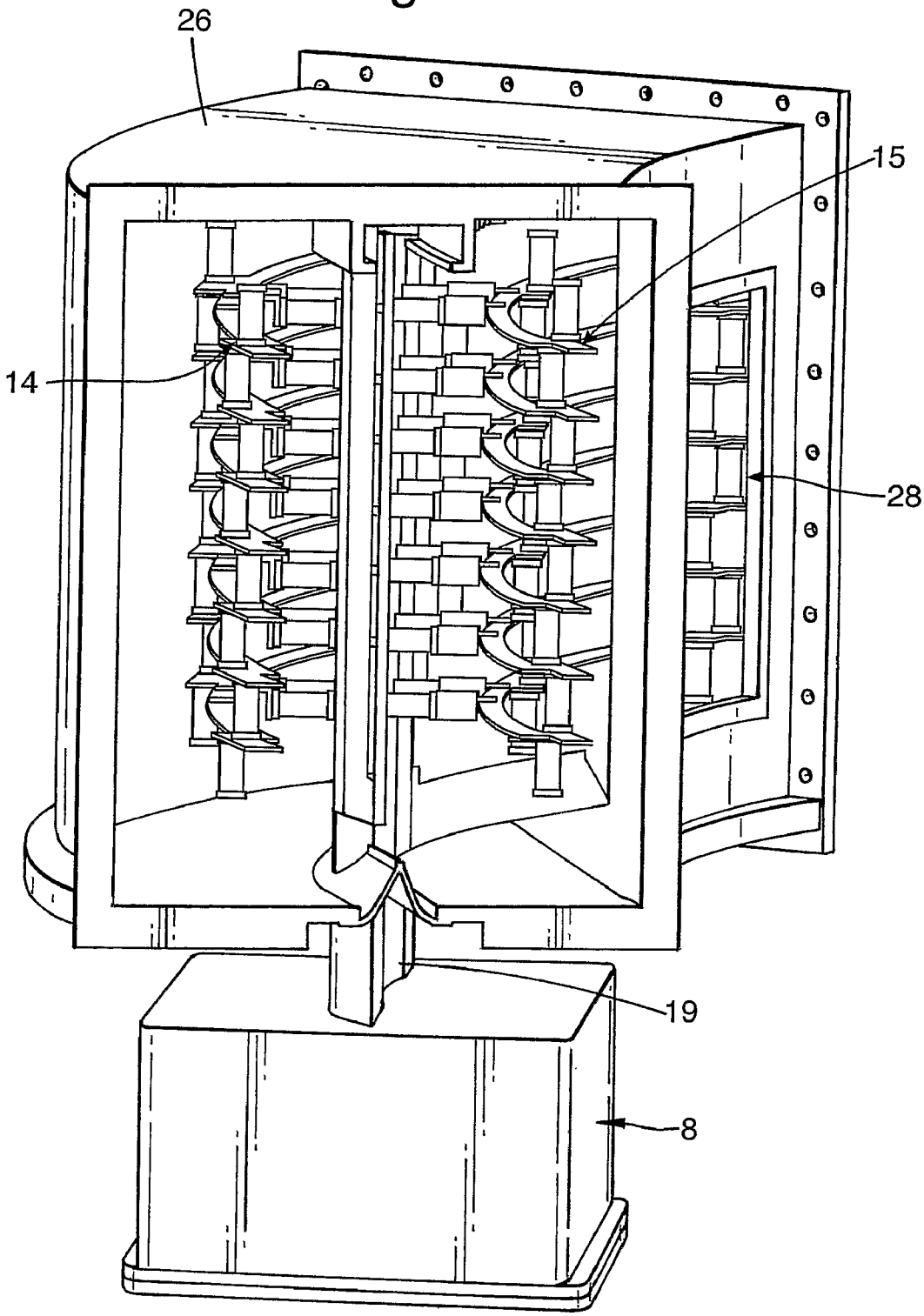
FIGS. 4 and 5 are side elevation views of two respective sections of the slip-ring housing.
Figure 5:
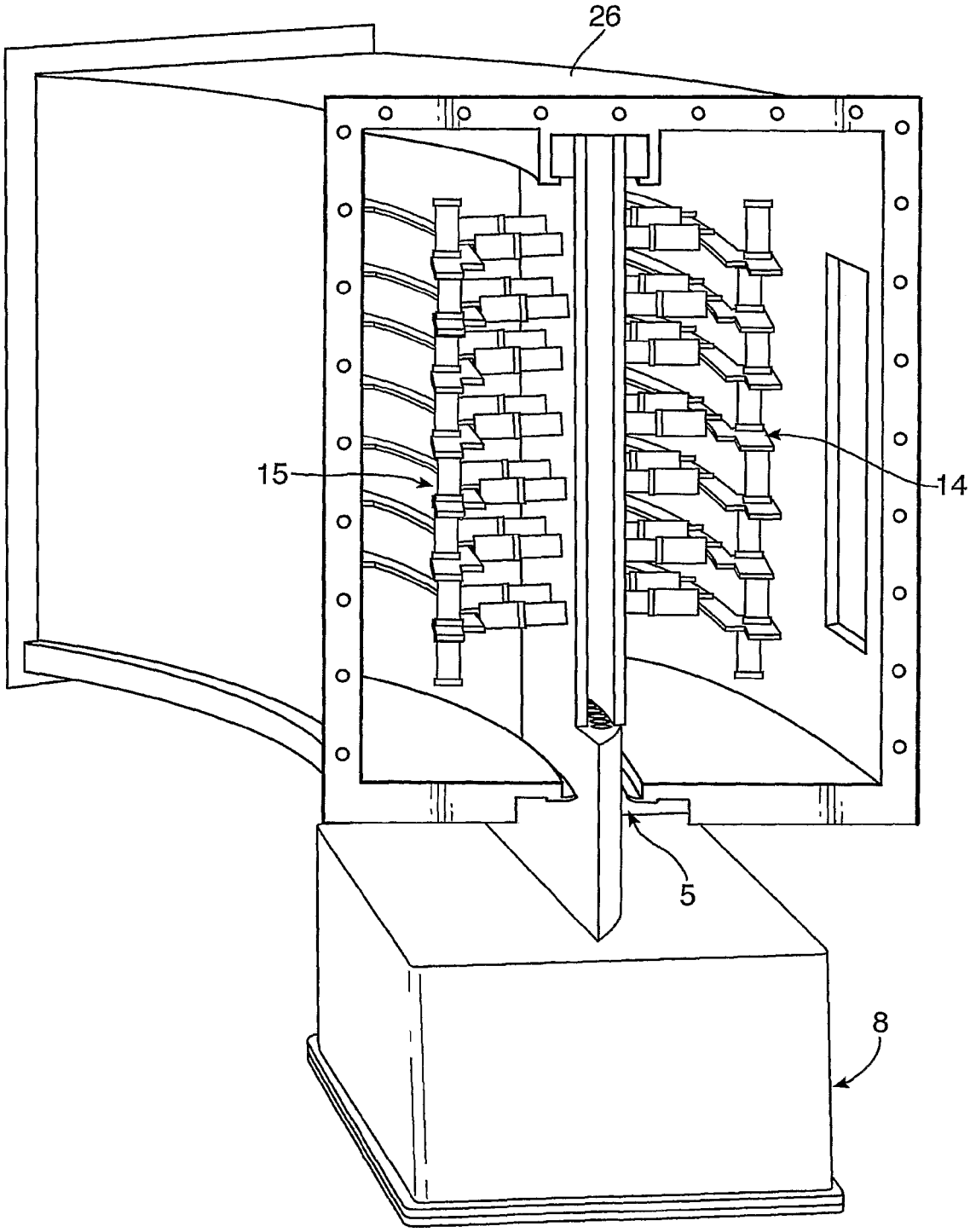

With reference to FIG. 4, the sealing system for the housing 8 features a dynamic seal 17 with a continuous sealing surface around the whole circumference of the housing 4. The brush carrier 8 is fixed to the metal sealing-plate 19 and there is no geometric change to the sealing surface as a result of the carrier passing by.

Figure 6:
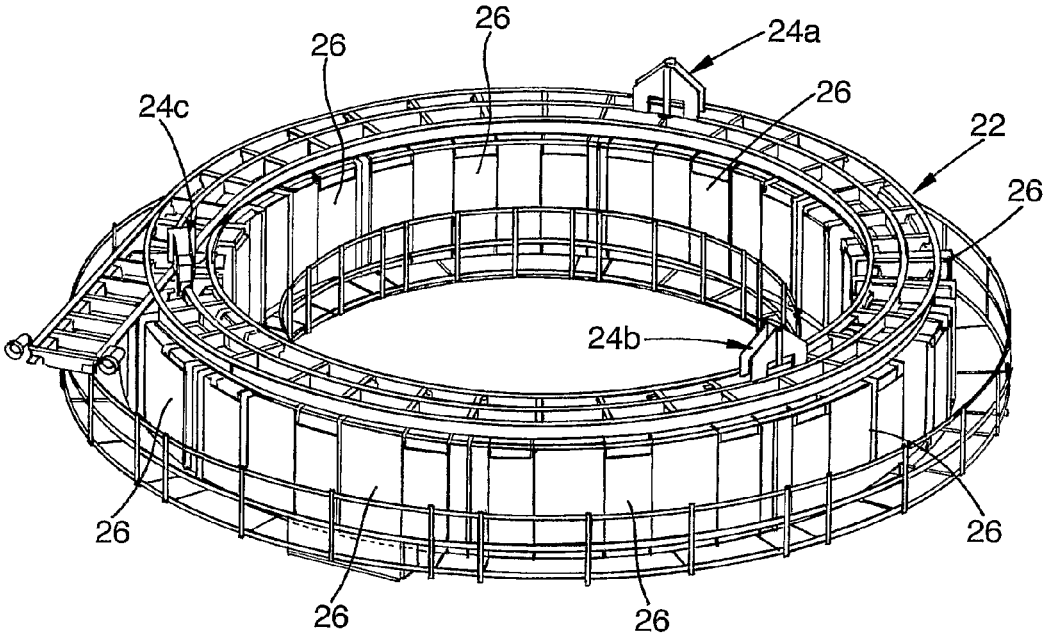
FIG. 6 is a perspective view of the slip-ring housing and associated support track.
Figure 7:
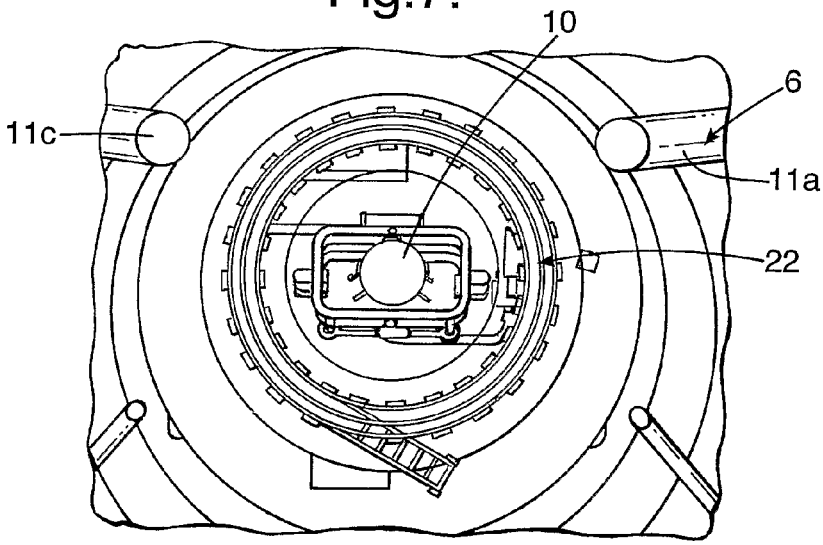
FIG. 7 is a plan view of the support frame and the slip-ring housing disposed within the turret and the swivel unit.
Figure 8:
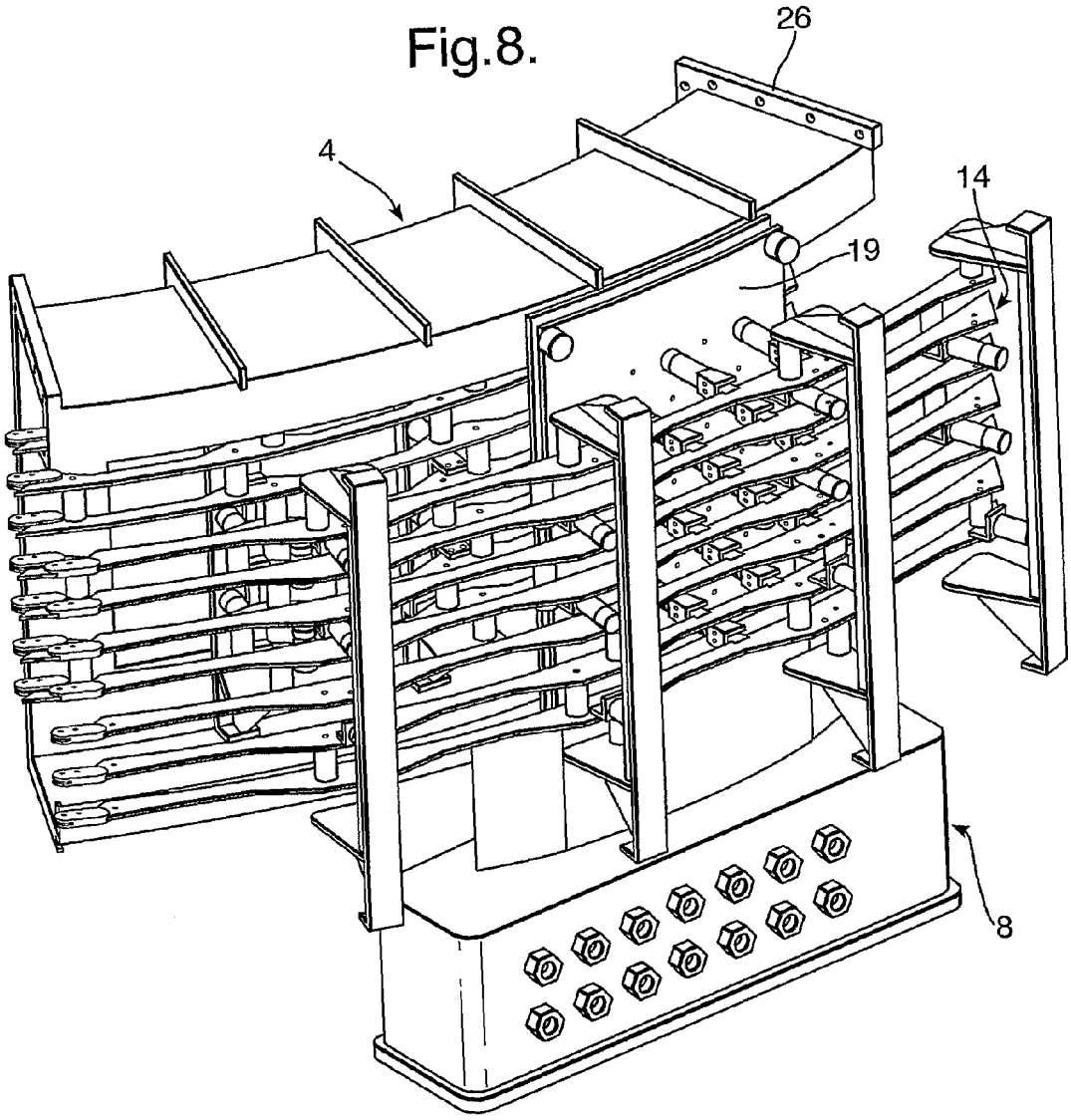
FIG. 8 is a side perspective view of the slip-ring housing and the bush carrier and shows part of the housing removed.

With reference to FIGS. 6 and 7, the total EPSR system 3 is attached to a circular support tract structure 22 by three support bearings 24*a*, 24*b*, 24*c*. The bearings 24*a*, 24*b*, 24*c* are of pin type free to rotate in x- and Y directions. The loads of the EPSR system 3 are transferred via the guide rails/bearings and fastening clamp into the web on the support tract structure 22.

The EPSR system 3 is based on the following design philosophy:

- All maintenance- and hook-up activities to be carried out from outside via hatches.
- Cold work installation. (Shut down limited to commissioning)
- EPSR divided into 8 sections for easier handling during installation of internal equipment and installation offshore.
- Guide rails system for easy handling during installation.
- Support shall be type free rotation (only vertical/horizontal load transfer) in order to avoid local bending from the gantry structure.
- 3-point support as base case in order to reduce gantry induced forces (gantry deflections) acting on EPSR to a minimum.
- Access platforms along both inner/outer circles.
- Avoid interference with other equipment.

The geometry of the EPSR system 3 is based on the following conditions:

- An Existing Swivel Stack encircle may be up to 7900 mm
- Maintenance access philosophy
- Required space inside for electrical equipment
- Keep the total height for EPSR (including support structure) as low as possible The main mechanical equipment assemblies of the EPSR system 3 are the slip-ring housing 4, slip-ring internals 14, 15, sealing system and the brush carrier 8.

The main purpose of the slip-ring housing 4 is to:

- Protect the high voltage and low voltage slip-rings from ambient
- Establish an over pressurized volume that can be maintained so the requirements for electrical equipment in the turret area can be met.
- Provide structural support for the slip-ring system 14, 15 internals
- Provide a connection/feed-through of the vessel-side high voltage power cables and low voltage supply cables The main purpose of the slip-ring internals 14, 15 are:

- Provide a transfer of electrical power (and signals) independent of vessel movement's vs. the turret 2, from the vessel-side to the turret 2.

The main purpose of the brush carrier 8 is to:

- Provide a connection/feed-through to the turret 2 side high voltage power cables and low voltage supply cables.

The EPSR housing 4 is designed as a plate stiffener solution, with stiffeners outside the main box profile. Outside and inside the ring box are access hatches 28 for hook-up and maintenance purposes.

The brush carrier 8 is fixed to the turret structure 2 and therefore geo-stationary, i.e. the vessel and EPSR housing 4 is moving relative to the brush carrier 8. The brush carrier 8 is a junction box (lower end—outside of EPSR housing 4) for the cables that enters the turret 2, as well as structural assembly for the high voltage, and low voltage brushes in contact with the HV&LV rings.

Figure 9:
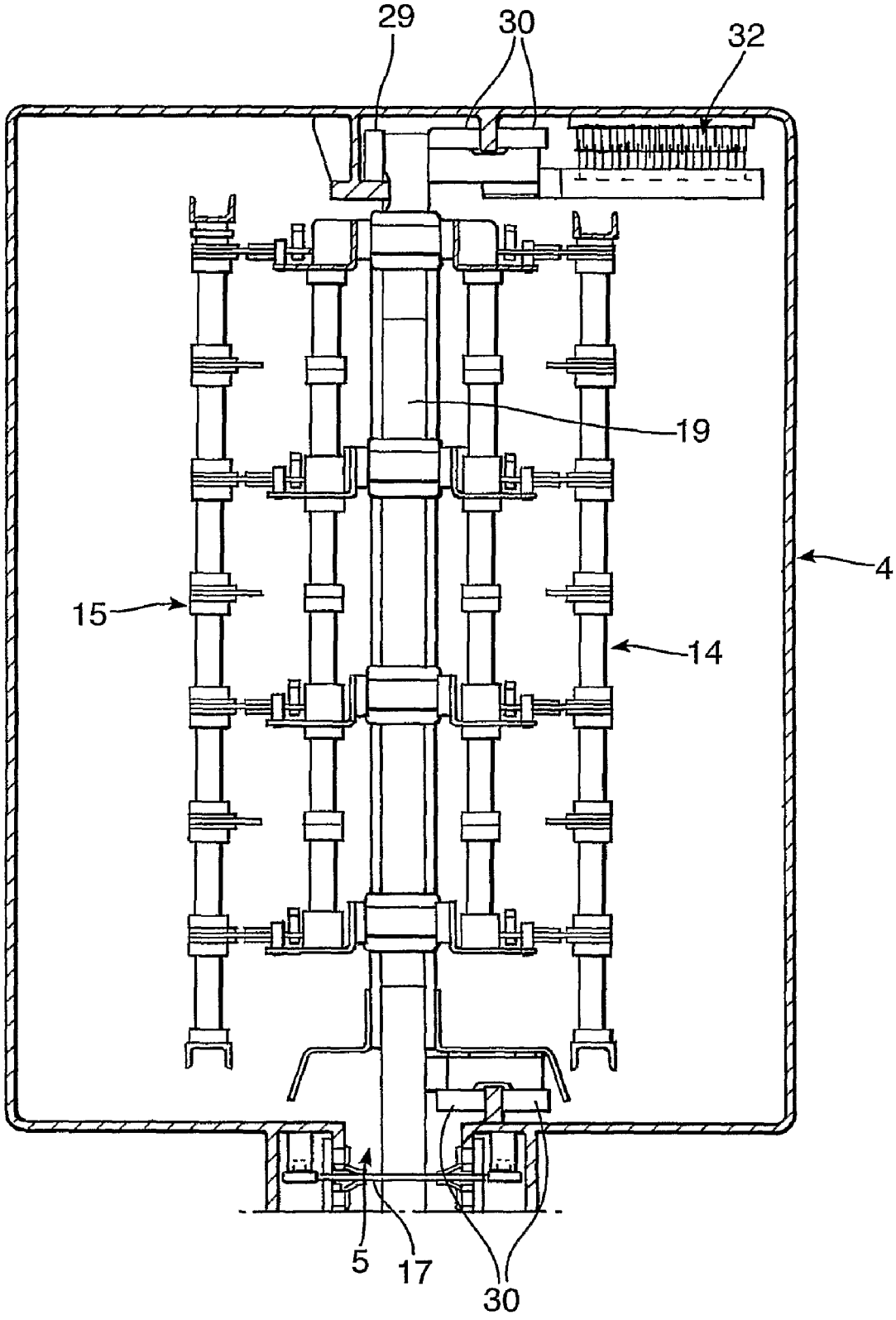
FIG. 9 is a cross-section view showing the slip-ring housing.

The FIG. 9 shows details of how the brush and isolator carrying support is hung off by rollers 29 in the top of the EPSR housing 4 roof. In addition there are rollers 30 at the top and bottom elevation of the brush support engaging a rail at the same locations, in order to handle forces in the horizontal plane. The low voltage supply and signals are carried through the slip-ring system at the upper right corner 32 of the housing 4.

In order to reduce wear of brushes and sealing system, the brush carrier will be mounted to a torque arm with a deadband mechanism, such that the brush carrier do not follow the vessel rotation for a few degrees at any location. This will reduce wear and stress on bearings and brushes due to cyclic movements of the vessel back and forth.

The total EPSR system 3 is hanged up in the gantry support tract 22 by three support bearings 24*a*, 24*b*, 24*c*. The bearings 24*a*, 24*b*, 24*c* are of pin type free to rotate in x- and Y directions. The EPSR loads are transferred via the guide rails/bearings and fastening clamp into a web on the supporting girders.

The sealing system between ambient and slip-ring system 3 internals is an important part of the EPSR system 3 requirement. The present invention may comprise one of two different types of sealing solutions.

Figure 10:
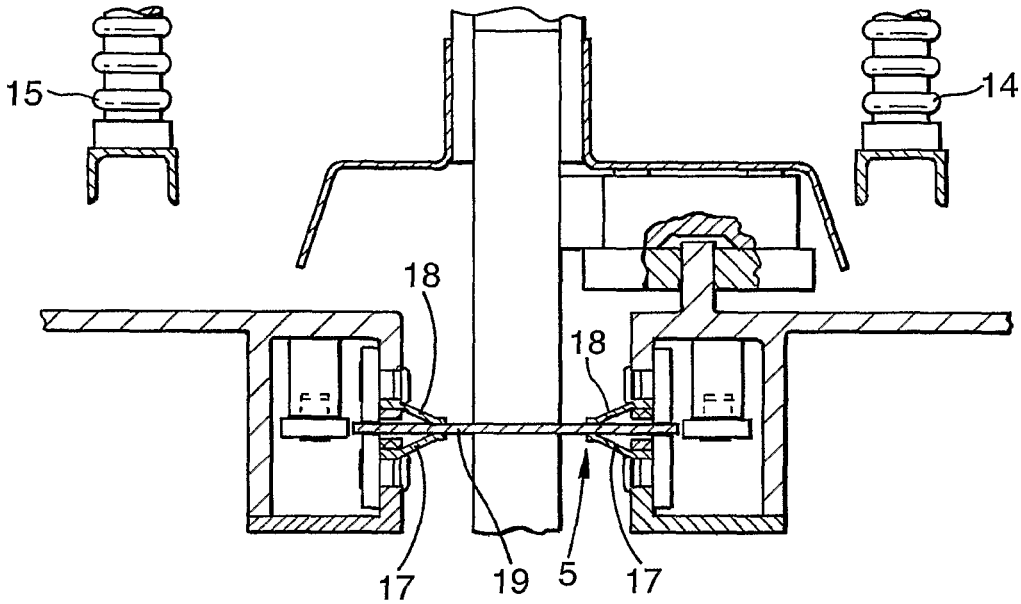
FIGS. 10 and 11 are detailed cross-section views of a seal arrangement for the slip-ring housing.
Figure 11:
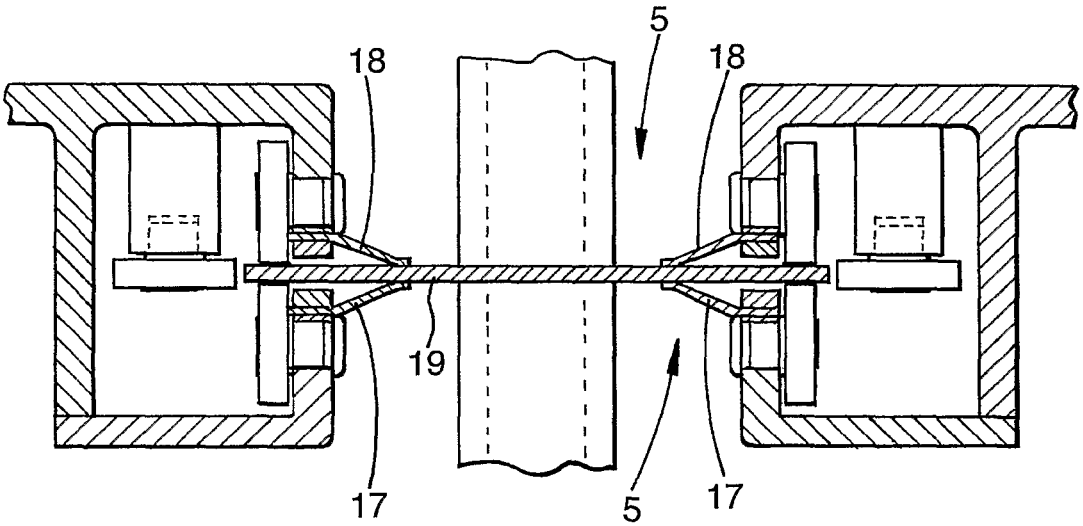

The first type of seal arrangement is based on a seal 17 (See FIGS. 10 and 12) that is in sliding contact with against a plate 19 which is arranged within the channel 5 of the housing 4 around the whole periphery. This plate 19 extends around the circumference of the channel 5 and therefore the housing 4. The plate 19 is fastened to the brush carrier 8 which holds the brush arrangement, and is stationary in relation to the turret 2. The seals 17 are mounted on the rotating house. The plate 19 must have steering and guides (with rollers or other mechanisms) to ensure that the disk is not jammed when the ship is rotating.

The first type of seal arrangement of the sealing system may comprise an external seal 17 and an internal seal 18 in sealing contact with a plate 19. The internally over pressurized sealing system should prohibit any gas to enter into the internals of the high voltage environment. An external seal is included to ensure that wind loads/other environmental conditions will not influence the internal sealing action. These two functional requirements are important design requirements of the sealing system. The sealing system features dynamic seals with continuous sealing surface around the whole circumference of the EPSR system 3. The seal plate 19 is running on rollers evenly distributed through the complete circumference.

Figure 12:
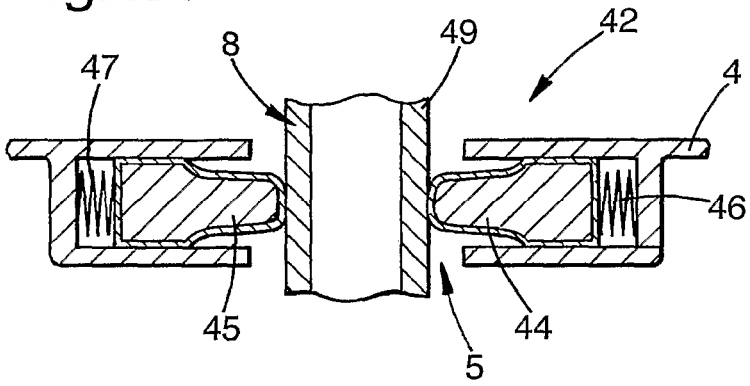
FIGS. 12 to 15 are a further detailed views of various embodiments of a seal arrangement for the slip-ring housing.
Figure 13:
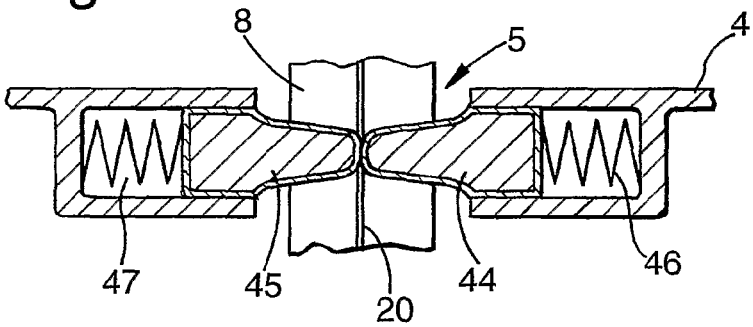

With reference to FIGS. 12 and 13, there is shown second type of sealing system. The alternative sealing system is based on seals which are abutting each other in the whole of the aperture of the house around the whole of the periphery. The carrier 8 which holds the brush arrangement will run in the channel 5. The carrier 8 will be stationary in relation to the turret 2. The carrier 8 will therefore open the seal in a small sector given by the length of the carrier 8. There are described below various sealing solutions that all may be possible solutions for the system.

The alternative sealing system (see FIGS. 12 and 13) comprises a pair of slidable seal members 44, 45 and respective compressive springs 46, 47. The seal members 44, 45 extend around the circumference of the channel 5. The seal members 44, 45 are urged in a direction towards each other by the compressive springs 46, 47. The distal ends of the spring members 44, 45 abut each other and form a seal. As the bush carrier 8 passes along the channel 5 the leading edge 20 of the carrier 8 moves apart the distal ends of each member 44, 45 and two respective side seal plates 49, 50 force back a portion of the members 44, 45 and form a seal therewith. The seal members 44, 45 are forced away from each other and compress each springs 46, 47 (see FIG. 12). The distal ends of each member 44, 45 are in sliding contact with the carrier 8.

Figure 14:
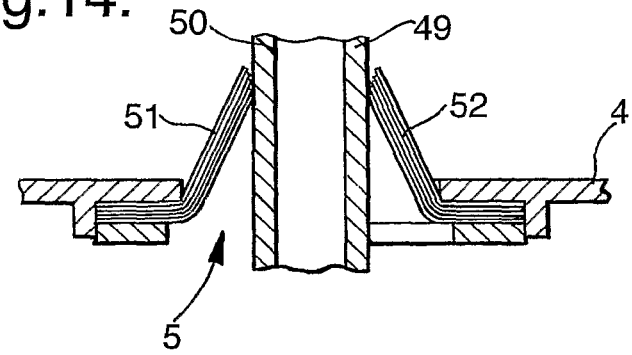
Figure 15:
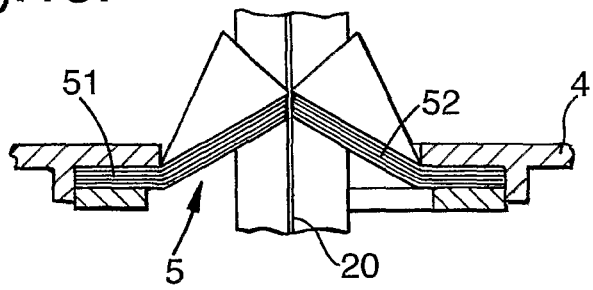
Figure 16:
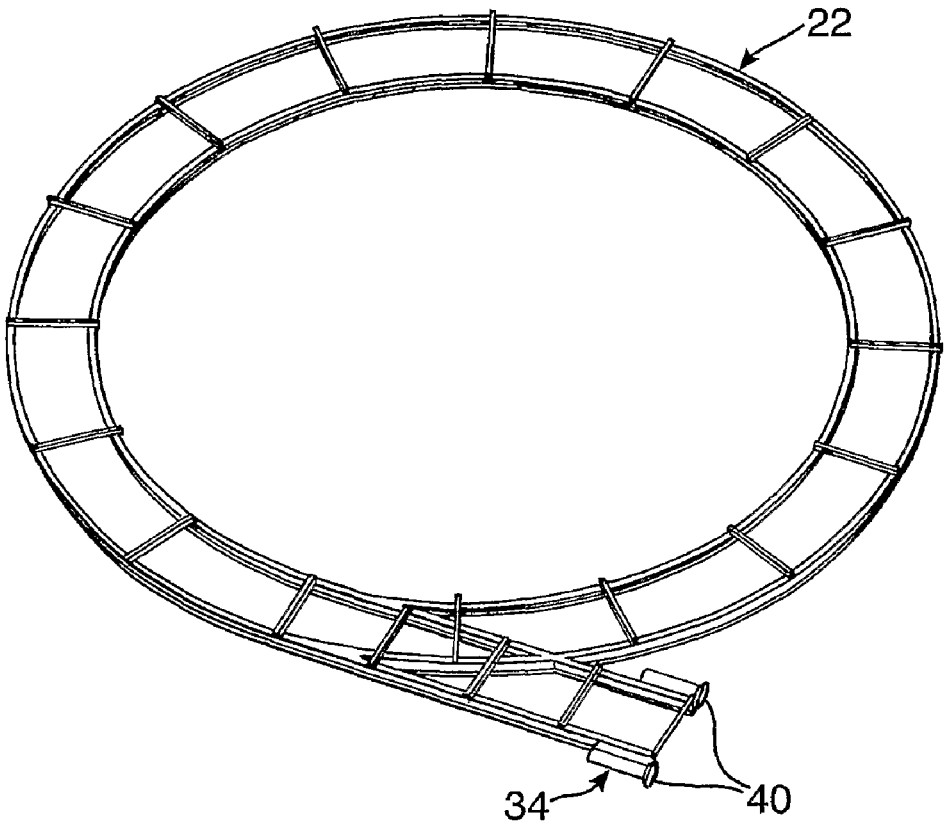
FIGS. 16 to 18 and FIGS. 21 to 22 are top perspective views of the support track for the slip-ring housing and shows the assembly of part of the housing a crane.
Figure 16:
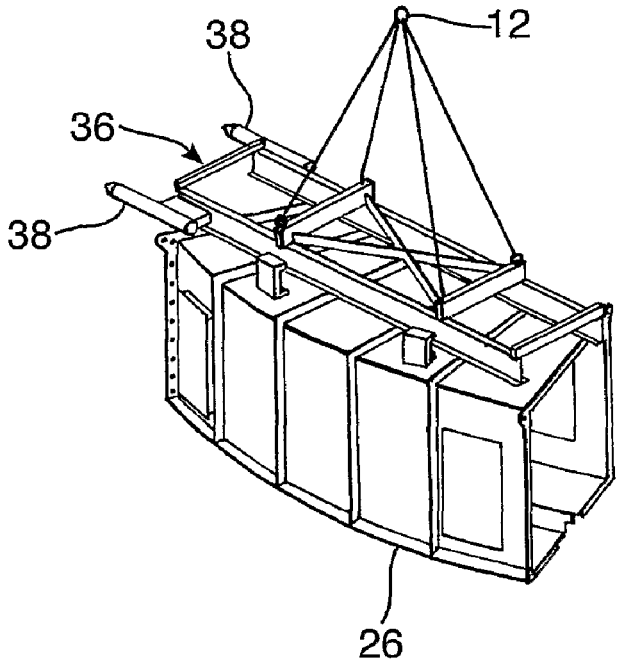
Figure 16A:
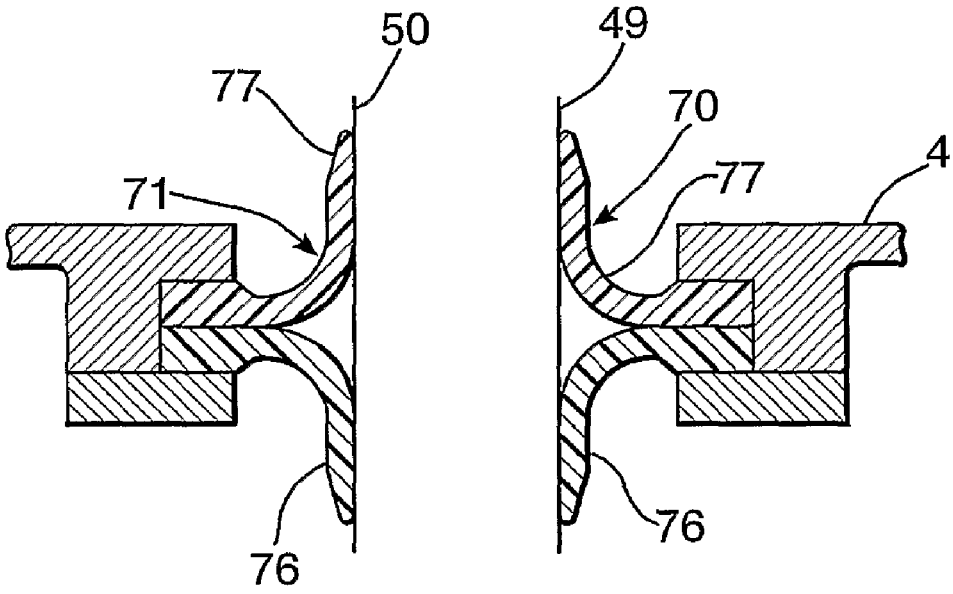
Figure 16B:
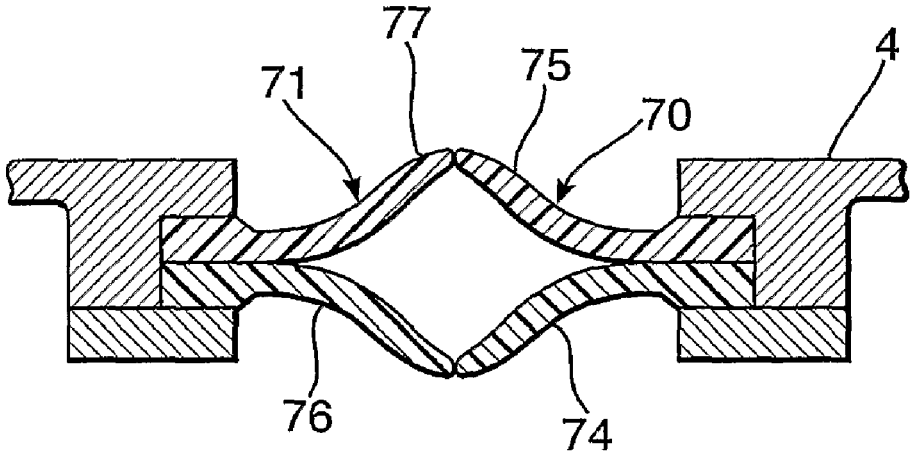
Figure 17:
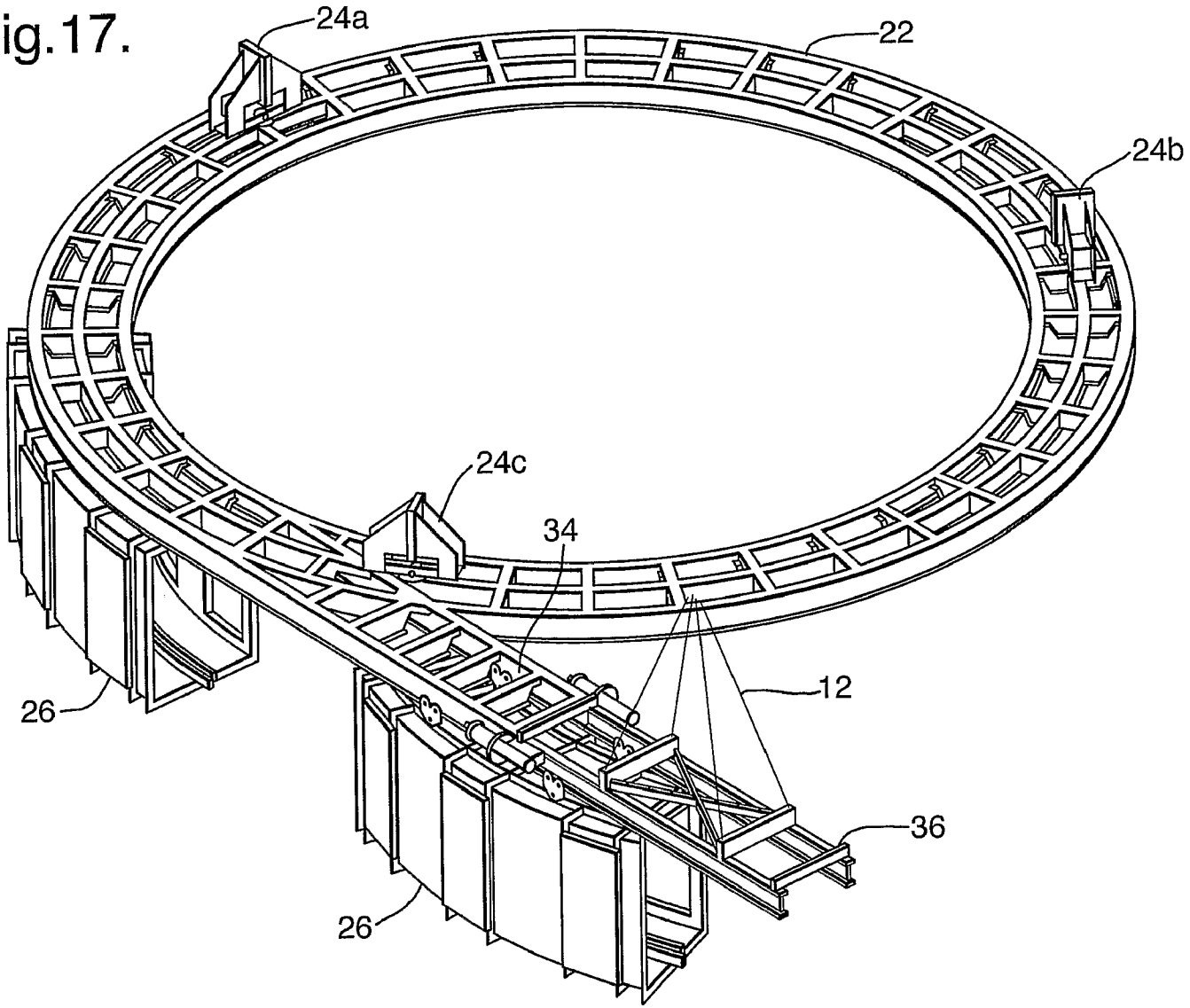
Figure 18:
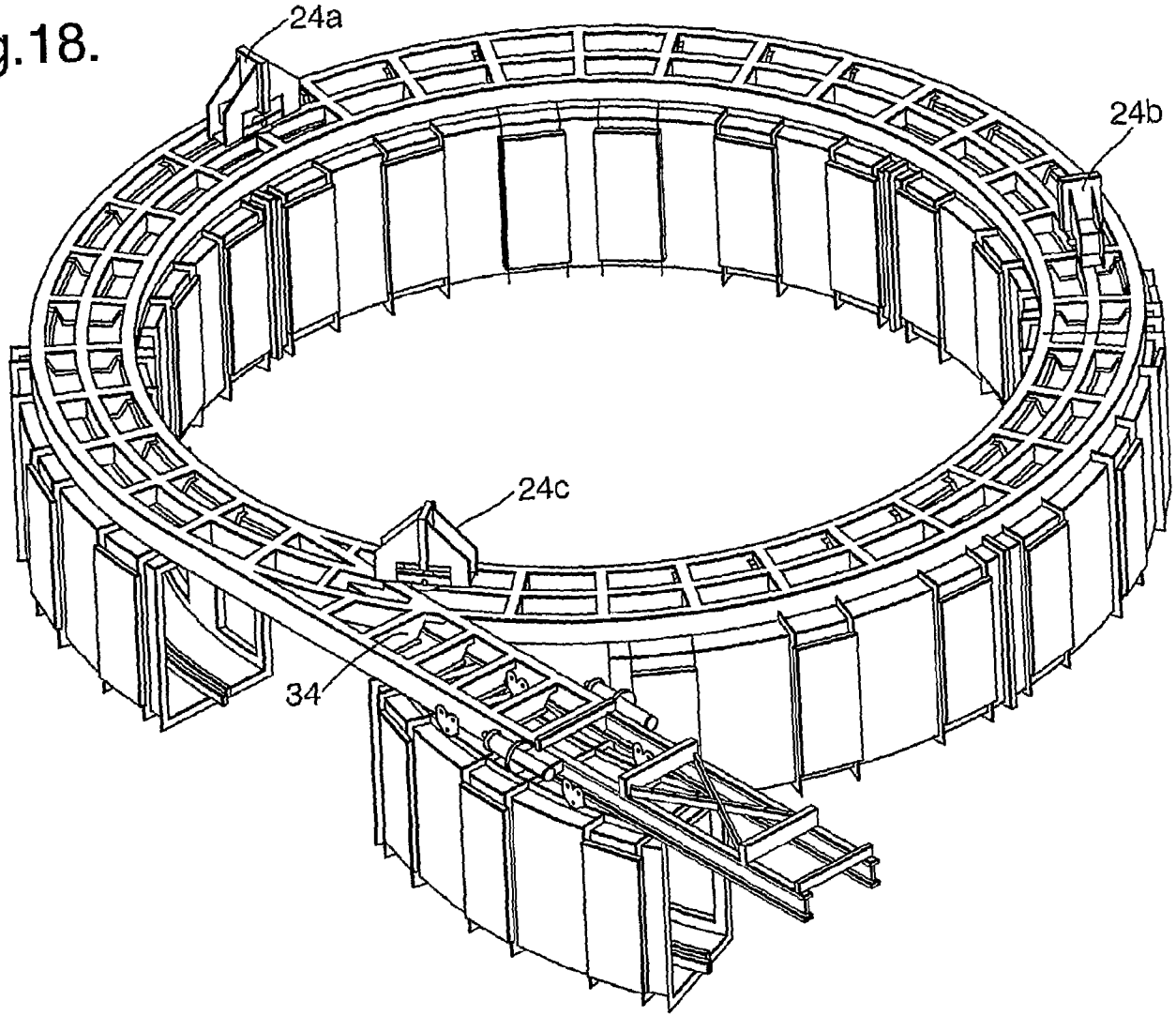
Figure 19:
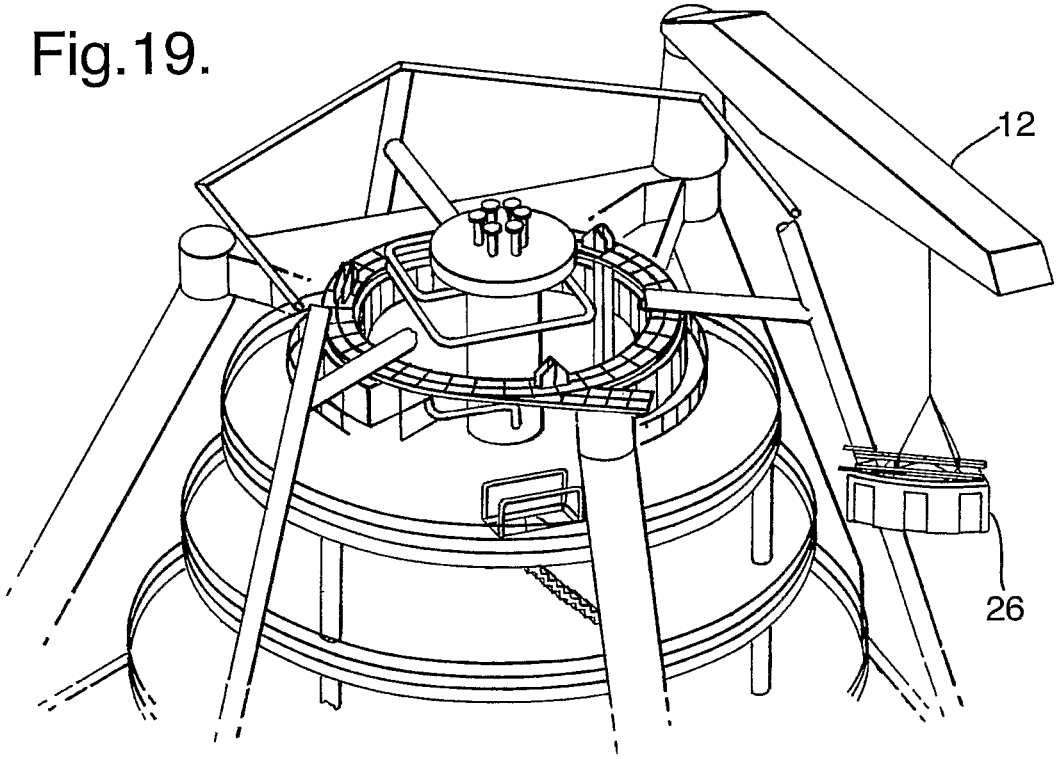
FIG. 19 is a top perspective view of the turret, the swivel and the support track for the slip-ring housing and shows the assembly of part of the housing a crane.
Figure 20:
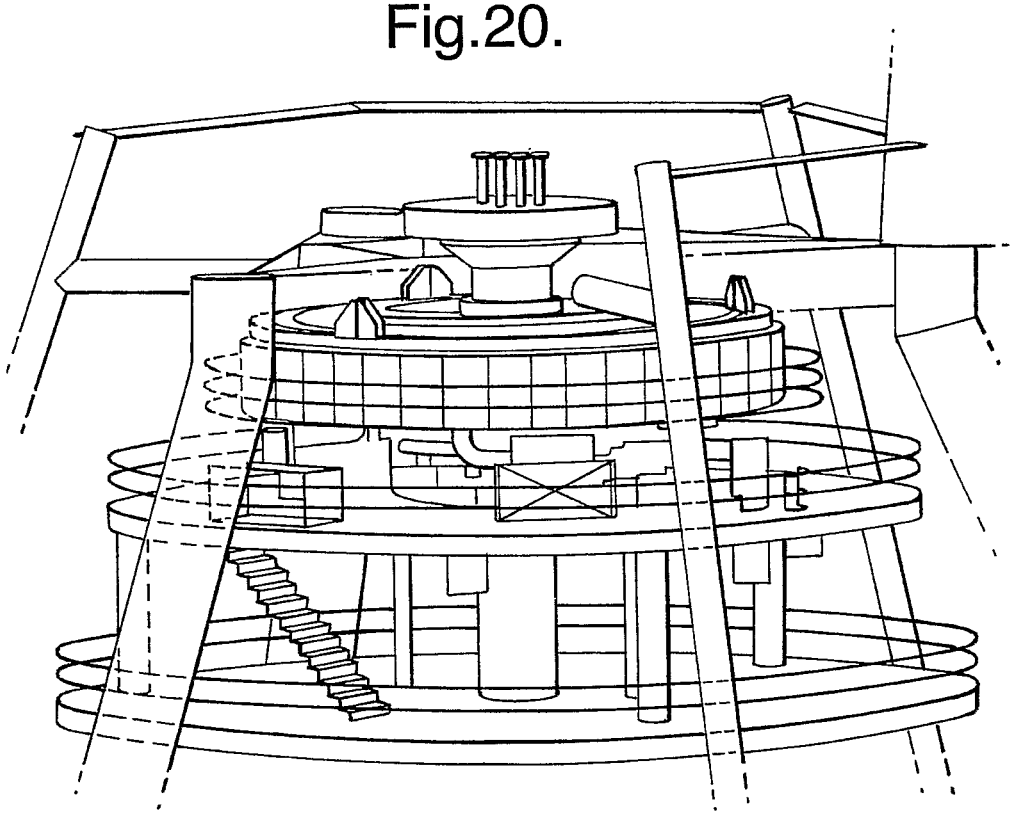
FIG. 20 is a side perspective view of the turret, the swivel and the support track for the slip-ring housing.
Figure 21:
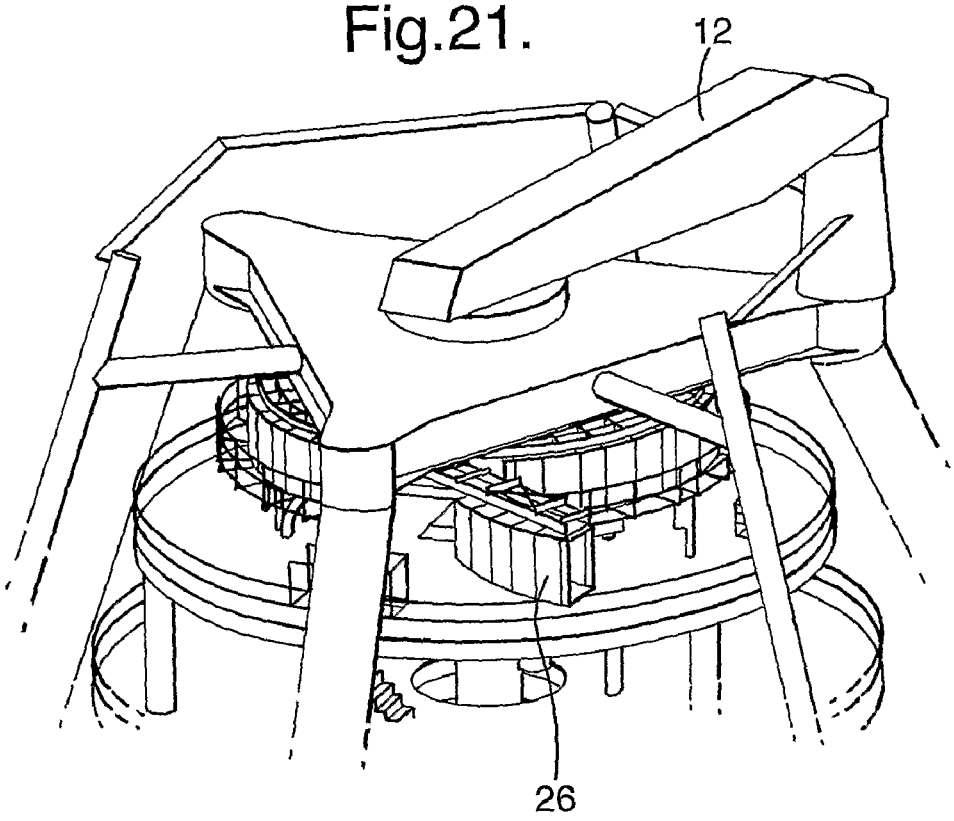
Figure 22:
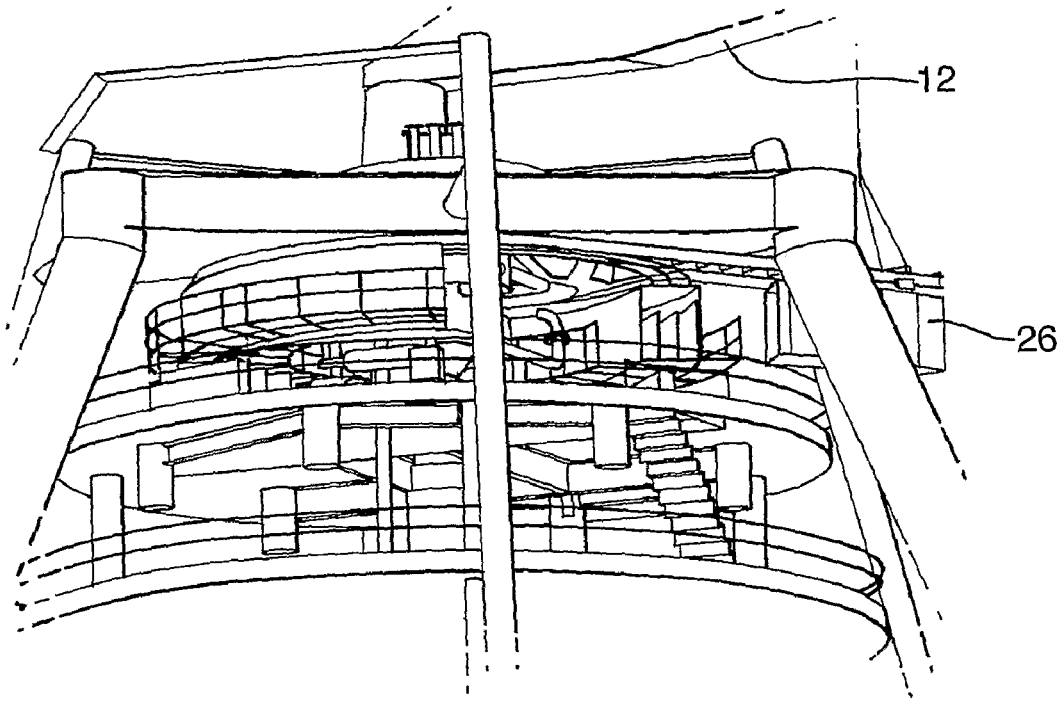
Figure 23:
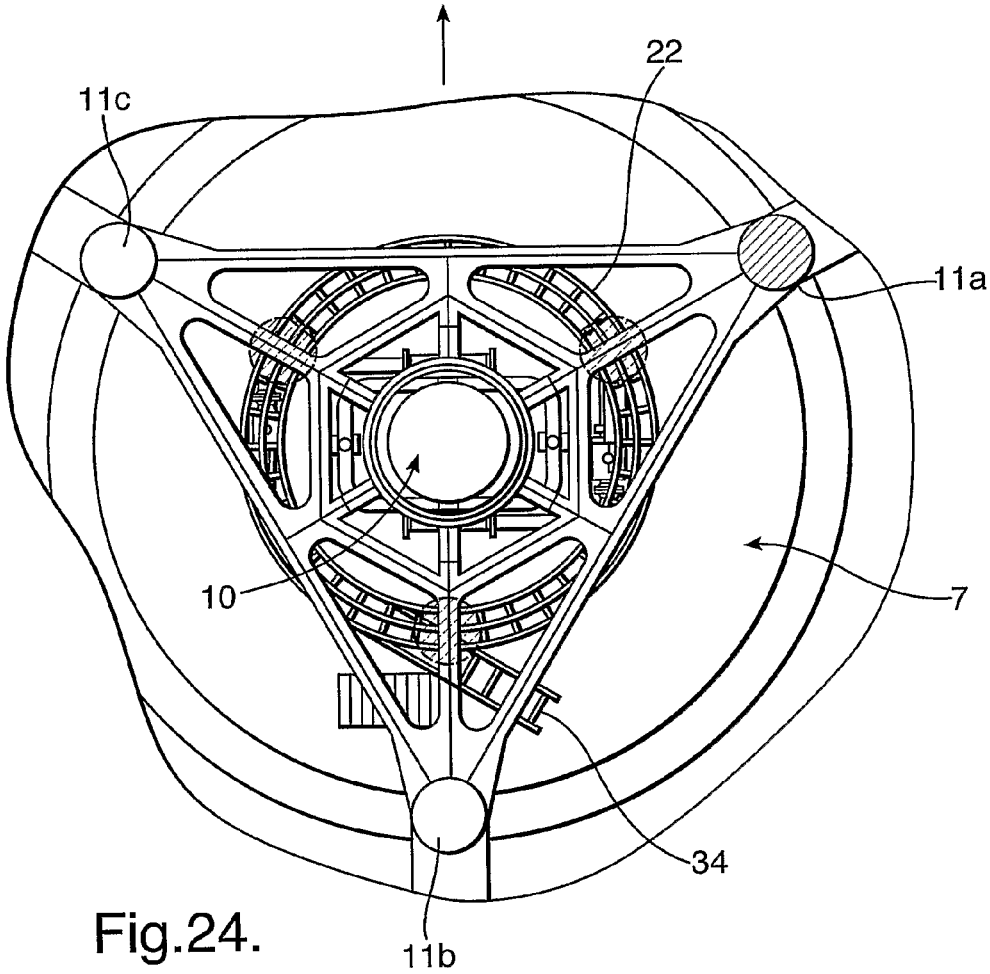
FIG. 23 is a plan view of the turret, swivel and support track for the slip-ring housing.
Figure 24:
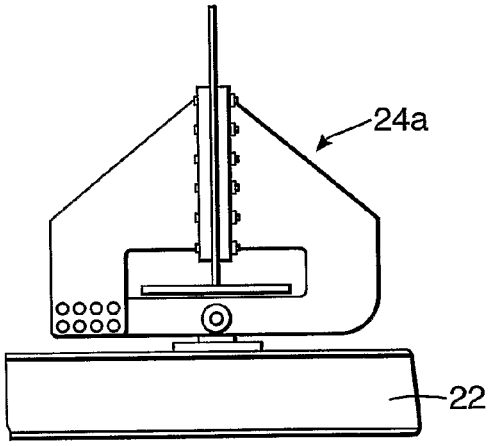
FIG. 24 is a section view through AA.
Figure 25:
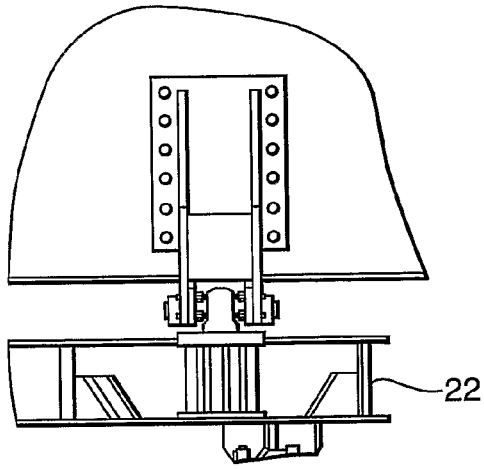
FIG. 25 is a section view through BB.
Figure 26:
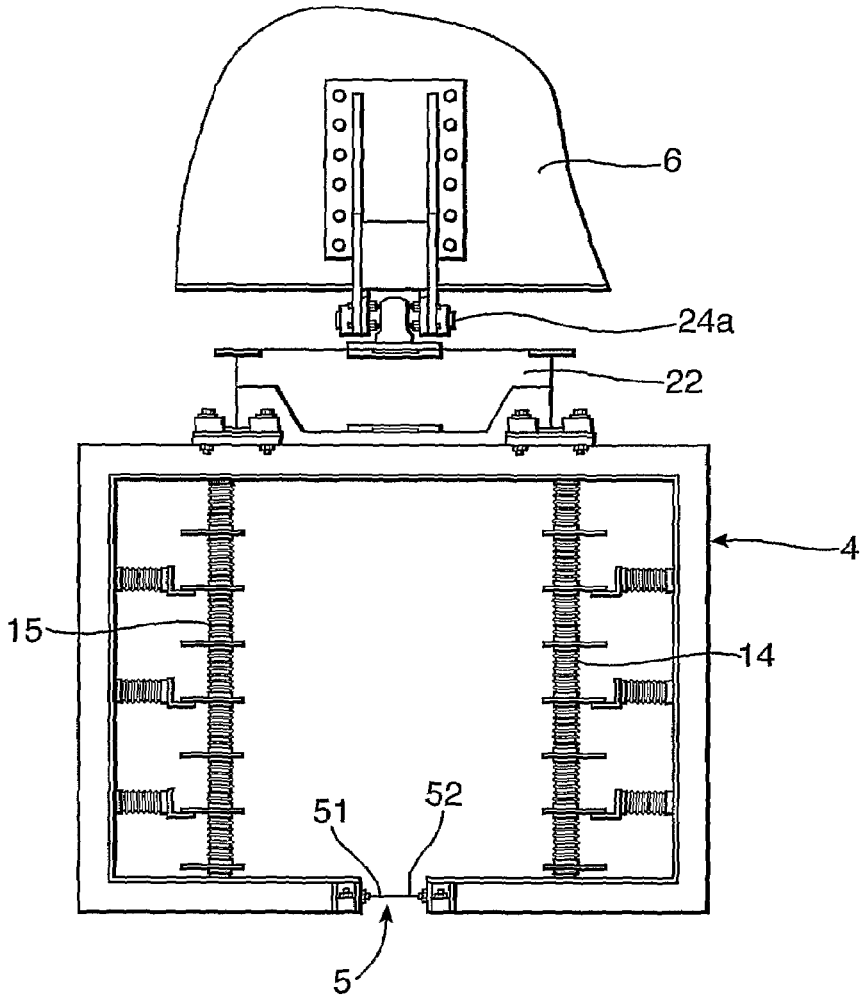
FIG. 26 is a side section view through the slip-ring housing and the support track.

With reference to FIGS. 14 and 15, there is shown a further alternative sealing assembly comprising a pair of planar laminate seal members 51, 52. The seal members 51, 52 extend around the circumference of the channel 5. The seal members 51, 52 are urged in a direction towards each. The distal ends of the spring members 51, 52 abut each other and form a seal. As the bush carrier 8 passes along the channel 5 the leading edge 20 of the carrier 8 moves apart the distal ends of each member 51, 52 and two respective side seal plates 49, 50 force back a portion of the members 51, 52.

Figure 12A:
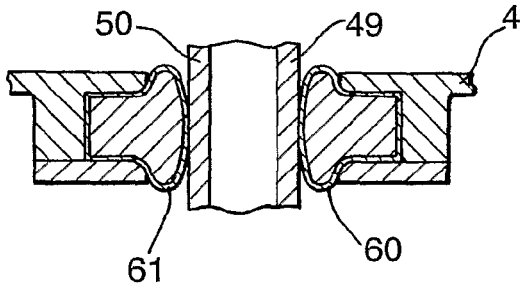
Figure 12B:
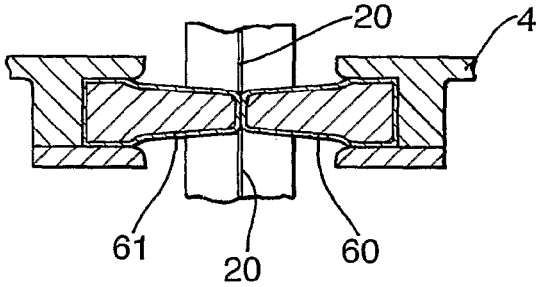

With reference to FIGS. 12*a* and 12*b*, there is shown a further alternative sealing assembly comprising a pair of resiliently compressive seal members 60, 61. The seal members 60, 61 extend around the circumference of the channel 5. The seal members 60, 61 are urged in a direction towards each by their resilient characteristics. As the bush carrier 8 passes along the channel 5 the leading edge 20 of the carrier 8 moves apart the distal ends of each member 60, 61 and two respective side seal plates 49, 50 force back a portion of the members 60, 61 and the seal members 60, 61 are forced away from each other and flex outwards (see FIG. 12*a*).

Figure 13A:
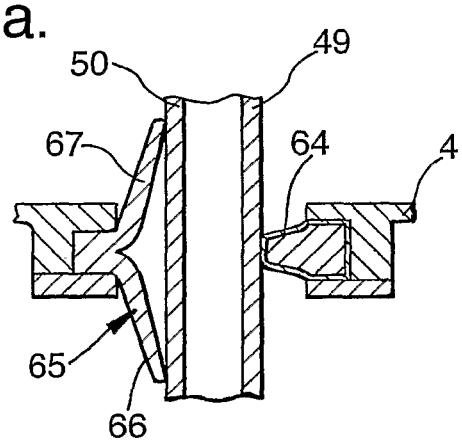
Figure 13B:
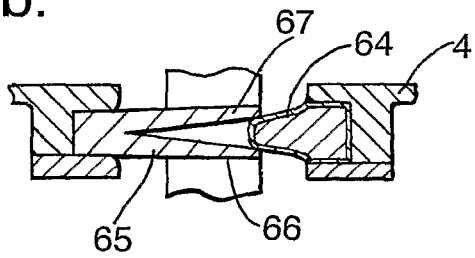

With reference to FIGS. 13*a* and 13*b*, there is shown a further alternative sealing assembly comprising a pair of resiliently compressive seal members 64, 65. The seal members 64, 65 extend around the circumference of the channel 5. The seal member 64 is urged in a direction towards the other seal 65 by its resilient characteristics. The seal member 65 comprises a pair of flexible limbs 66, 67. The distal ends of each limb 66, 67 is in sealing contact with the member 64 (see FIG. 13*b*). As the bush carrier 8 passes along the channel 5 the leading edge 20 of the carrier 8 moves apart the distal ends of each member 64, 65 and two respective side seal plates 49, 50 force back a portion of the members 64, 65 and the seal members 64, 66, 67 are forced away from each other and flex outwards (see FIG. 13*a*).

With reference to FIGS. 14*a* and 14*b*, there is shown a further alternative sealing assembly comprising a pair of resiliently compressive seal members 70, 72, which extend around the circumference of the channel 5. The seal members 70, 72 each comprises a pair of flexible limbs 74, 75, 76, 77. The respective distal ends of each limbs 74, 75 is in contact with the corresponding distal end of the limbs 76, 77 (see FIG. 14*b*). The seal members 70, 72 are urged in a direction towards each other by their resilient characteristics. As the bush carrier 8 passes along the channel 5 the leading edge 20 of the carrier 8 moves apart the distal ends of each member 70, 72 and two respective side seal plates 49, 50 force back a portion of the members 70, 72 the flexible limbs 74, 75, 76, 77 are forced away from each other and flex outwards (see FIG. 14*a*).

The advantage of the second type of sealing arrangement is that there is only sliding friction contact between the plates of the carrier and the sealing elements as the carrier moves relative to the seals.

The EPSR system 3 is designed for easy handling during installation offshore. Therefore the housing 4 (complete with electrical equipment) and the support track 22 are divided into sections for easy handling during offshore assembly. The system 3 includes the following items:

EPSR Sections 26 (housing—8 off)
Guide Rail sections (6 off)
Brush carrier 8
Purge unit
Support Clamps FIGS. 16 to 22 show the assembly of the EPSR system 3. First the support tract 22 is assembled by bolting together each of the sections to form the circular track 22 and a short entry spur 34. Then the first section 26 of the housing 4 is brought to the spur 34 using a lifting rig 36 supported by the crane 12. The rig 36 comprises to parallel guide pins 38 that are adapted to be received by corresponding guide funnels 40 on the distal end of the spur 34. A temporary trolley system is assembled on each section 26 between the section and the rig 36 to allow the section to be rolled into position. A section 26 is lifted up (with the crane 12) and the guide pins 38 are entering the guide funnels 40 on the rails of the spur 34. Then the section 26 is moved into the support track 22 and moved into position. The section 26 is secured with tension wires as soon as it is in the correct position. This operation is repeated for all of the sections 26. The last section 26 contains the bush carrier 8.

Installation of the final EPSR section 26 (number eight) is planned as follows:

Slide the first seven sections 26 into their positions.
All sections 26 are still resting on rollers and the housing sections 26 are loosely bolted together so that sections could move while inserting the last section.
The final section 26 (number eight) is lifted and guided to position ready for rotation into final position.
Pull out sections 26 number one and number seven; hold them in position by use of tension wires (Chain Blocks).
Fasten chain blocks for last movement and remove rollers from the final section 26 number eight.
Rotate the section 26 number eight in between number one and number seven by use of chain blocks.
Hang off section number eight to the circle part of the guide rails by use of rollers.
The whole ring housing 4 is now ready for final fastening and hook-up.

When the 8 sections 26 are lifted into place the trolley system is removed and the EPSR system 3 is lifted up and secured to the support track 22. The cables from the vessel side to the EPRS system 3 can then be connected.

The seal system is installed after completion of the EPSR housing assembly. The brush carrier 8 is locked in one of the sections 26. Installation sequence may be as follows:

Clean all contact surface before inserting the seal elements.
Install upper rubber seal all the way round.
Insert the first roundel steel plate and connect to brush carrier by temporary bolts.
Install lower support segment, including support roller bearing and fasten the lower seal end.
Follow the same procedure all the way round.

Figure 27:
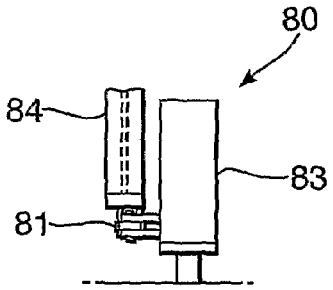
FIG. 27 is a side elevation of a torque arm assembly for the slip-ring housing.
Figure 28:
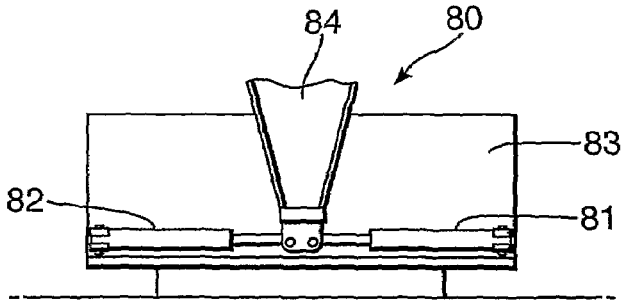
FIG. 28 is a front elevation of the torque arm assembly shown in FIG. 27.

With reference to the FIGS. 27 and 28, there is shown a torque arm arrangement 80 comprising a pair of torque arms 81, 82, a mounting plate 83 and a central connection plate 84. The torque arms 81, 82 are formed in such a manner that the vessel may rotate a small angle without the slip ring housing moving. This is given by the stroke of the dampers that are coupled between the stationary turret 2 fastening and the rotating housing 4. The length is adapted to the vessel patter of movement and is dependent on the specific application. The Torque arm arrangement is designed to allow some small movements prior to engagement. This solution will reduce wear on the seal system. The torque arm arrangement connects the brush carrier to the turret. The Torque arm system is designed to allow small relative movements between the ship and the turret to engagement. This will reduce wear on the seal system.

Once the EPSR system 3 is installed with the seal system and the next step is to install the torque arrangement 80 and power connectors. A typical installation sequence is as follows:

Move Brush Carrier to permanent position.
Fasten the Torque Arm arrangement (use a tug to keep vessel in position while connecting this system).

Now the carrier is locked to the turret and will follow the turret rotation.

Connect the flexible cable tray to the brush carrier.

Install cable connectors in the Junction Box.

Finally install protection cap.

It will be appreciated that the installation of the present invention may be a retro-fit on an existing turret and vessel arrangement or alternatively it may be assembled as part of a new turret and vessel fabrication.

The invention claimed is:

1. Means for transferring electric power and/or signals between a vessel and an underwater installation via a turret, wherein the means for transferring electric power and/or signals comprises a slip-ring arrangement comprising a housing containing an electrical conductor means, the housing being connected to the structure of the vessel and a brush carrier unit that is in slidable contact with the electrical conductor means, the brush carrier being fixed to the turret.

2. Means for transferring electric power and/or signals as claimed in claim 1, wherein the housing is formed by a plurality of sub-units, wherein each sub-unit comprises a section of the electrical conductor means.

3. Means for transferring electric power and/or signals as claimed in claim 1, wherein the housing is a substantially annular shape.

4. Means for transferring electric power and/or signals as claimed in claim 1, wherein the housing unit is an enclosed structure formed with an access channel through which the brush carrier unit extends.

5. Means for transferring electric power and/or signals as claimed in claim 4, wherein the access channel extends through the length of the housing.

6. Means for transferring electric power and/or signals as claimed in claim 4, wherein the channel extends around the circumference of the housing.

7. Means for transferring electric power and/or signals as claimed in claim 1, wherein the housing is suspended from a support structure mounted on the vessel.

8. Means for transferring electric power and/or signals as claimed in claim 7, wherein the housing is suspended by three mounting points on the support structure.

9. Means for transferring electric power and/or signals as claimed in claim 7, wherein the support structure extends along the length of the housing.

10. Means for transferring electric power and/or signals as claimed in claim 7, wherein the support structure extends around the circumference of the housing.

11. Means for transferring electric power and/or signals as claimed in claim 1, wherein the housing comprises means for sealing the channel.

12. Means for transferring electric power and/or signals as claimed in claim 11, wherein the means for sealing the channel comprises two sealing elements that are disposed on respective edges of the channel and that extend along the length of the channel.

13. Means for transferring electric power and/or signals as claimed in claim 11, wherein the seal means comprises an internal seal member and an external seal member.

14. Means for transferring electric power and/or signals as claimed in claim 11, wherein the seal means comprises a sealing plate that extends the length of the seal means.

15. Means for transferring electric power and/or signals as claimed in claim 14, wherein the seal means comprises a sealing plate that extends the length of the seal means, the arrangement being such that in use a seal member is in sealing contact with the sealing plate.

16. Means for transferring electric power and/or signals as claimed in claim 11, wherein the seal means is a dynamic seal having a continuous sealing surface.

17. Means for transferring electric power and/or signals as claimed in claim 1, wherein, in use, there is a positive pressure difference between the pressure in the housing compared with the atmospheric pressure outside the housing.

18. A method of assembling a means for transferring electric power and/or signals as claimed in claim 2, wherein the method comprises the steps of installing a support track on the vessel and transferring each sub-unit onto the support rack to form the completed slip-ring arrangement.

* * * * *